United States Patent [19]

Hiersteiner

[11] 4,180,168

[45] Dec. 25, 1979

[54] TWO-WAY ENVELOPE

[75] Inventor: Walter L. Hiersteiner, Shawnee Mission, Kans.

[73] Assignee: Tension Envelope Corporation, Kansas City, Mo.

[21] Appl. No.: 924,350

[22] Filed: Jul. 13, 1978

[51] Int. Cl.[2] ..... B65D 27/34; B65D 27/06

[52] U.S. Cl. ..... 206/626; 229/73

[58] Field of Search ..... 229/73, 72, 68 R; 206/626

[56] References Cited

U.S. PATENT DOCUMENTS

| | | | |
|---|---|---|---|
| 1,834,570 | 12/1931 | Becker et al. | 229/68 R |
| 1,895,267 | 1/1933 | Poppe | 229/68 R |
| 2,710,095 | 6/1955 | Robins | 229/68 R |
| 3,062,431 | 11/1962 | Rabenold | 229/73 |
| 3,512,702 | 5/1970 | Pritchard, Jr. | 229/73 |
| 3,558,040 | 1/1971 | Krueger | 229/73 |

FOREIGN PATENT DOCUMENTS

| | | | |
|---|---|---|---|
| 2253679 | 12/1973 | France | 229/73 |
| 3476 | 2/1912 | United Kingdom | 229/73 |

*Primary Examiner*—Stephen P. Garbe

*Attorney, Agent, or Firm*—Fishburn, Gold & Litman

[57] ABSTRACT

A two-way envelope includes a body portion, a pair of opposed side flaps, a bottom flap and a seal flap integrally connected to the body panel by a tear line. A fold line extends along the seal flap above the tear line and the side flaps have bold lines extending therealong in positions approximately colinear with the seal flap tear line and defining side flap upper portions having seal adhesive thereon. The side flaps are folded into partially overlapping relation and joined together forming a pocket with the body panel and the bottom flap. The seal flap is folded along the seal flap fold line over the side flap upper portions to seal the pocket for a first trip and the seal flap is removed from the body panel along the seal flap tear line whereupon the side flap upper portions are folded along the side flap fold lines to seal the pocket for a second trip. A method of producing the envelope is disclosed which includes the steps of applying the seal adhesive to the seal flap and the side flap upper portions as a single operation and on the same surface of an envelope blank, and folding the side flaps over the body panel causing the side flap adhesive to face in a direction opposite the seal flap adhesive.

7 Claims, 8 Drawing Figures

TWO-WAY ENVELOPE

This invention relates to envelopes and more particularly to envelopes suitable for reuse after a first mailing by detaching a selected portion of the original envelope prior to the second mailing.

BACKGROUND OF THE INVENTION

The use of two-way, or returnable mailing envelopes has been recognized as facilitating the transaction of business, for example, in the sending out of monthly statements by business firms where the customer is expected to return a portion of the statement with a remittance to expedite proper crediting of payments. Such return envelopes commonly utilized an extended seal flap having an upper portion adapted to be severed from the connection with the remainder of the seal flap, the remainder having seal gum or adhesive thereon for resealing the envelope. By way of example, U.S. Pat. No. 3,874,582 discloses such an arrangement wherein the upper portions of each of the side flaps together with other portions of the envelope, including the original seal flap, is removed allowing a top portion, formally integral with the seal flap, to be utilized for sealing in preparation for a second mailing. Also note U.S. Pat. No. 3,982,689 showing a returnable mailing envelope having a compound seal flap including an upper portion separated from a lower portion by a tear line and seal gum or adhesive strips extending along each portion.

Prior art returnable envelopes, however, tended to be complex, either in structure or in manufacture, necessitating a relatively high cost to the user.

SUMMARY OF THE INVENTION

In the practice of the present invention, a two-way or reusable envelope is provided which is both simple in construction and easily manufactured on conventional rotary envelope folding equipment. The body panel has a seal flap connected thereto by a tear line and a fold or score line extends along the seal flap spaced upwardly from said tear line. A portion of the seal flap above the fold or score line has seal gum or adhesive thereon. A pair of side flaps are connected to the body panel and have score or fold lines therealong which are approximately colinear with the seal flap tear line and upper portions above the side flap score lines, also with seal gum or adhesive thereon. The side flaps are folded inwardly in partially overlapping relation and joined together in the manner of a center seam envelope, whereby the seal flap may be folded along the seal flap fold line to seal the envelope for a first trip, and the seal flap may be removed along the seal flap tear line and the side flap upper portions folded along their fold lines to seal the envelope for a second trip.

Simplicity in manufacture is permitted since the seal gum is applied to the seal flap and the side flap upper portions as a single operation and on the same surface of the envelope blank. By merely folding the side flaps over the body panel, for producing the envelope pocket, the side flap gum faces in a direction opposite to the seal flap adhesive allowing the return use as noted.

The principal objects of the present invention are: to provide a two-way envelope which is simple in construction; to provide such an envelope which is easily utilized by the recipient for its intended purpose with minimal instruction; to provide such an envelope construction which is easily adaptable to variations in size; to provide a return envelope which is simple and inexpensive to produce on conventional rotary envelope folding equipment; and to provide such an envelope construction and method of making same which permits a significant overall cost saving for the user.

Other objects and advantages of this invention may become apparent from the following description taken in connection with the accompanying drawings, wherein are set forth by way of illustration and example certain embodiments of this invention.

DESCRIPTION OF THE PREFERRED EMBODIMENTS

Figure 1:
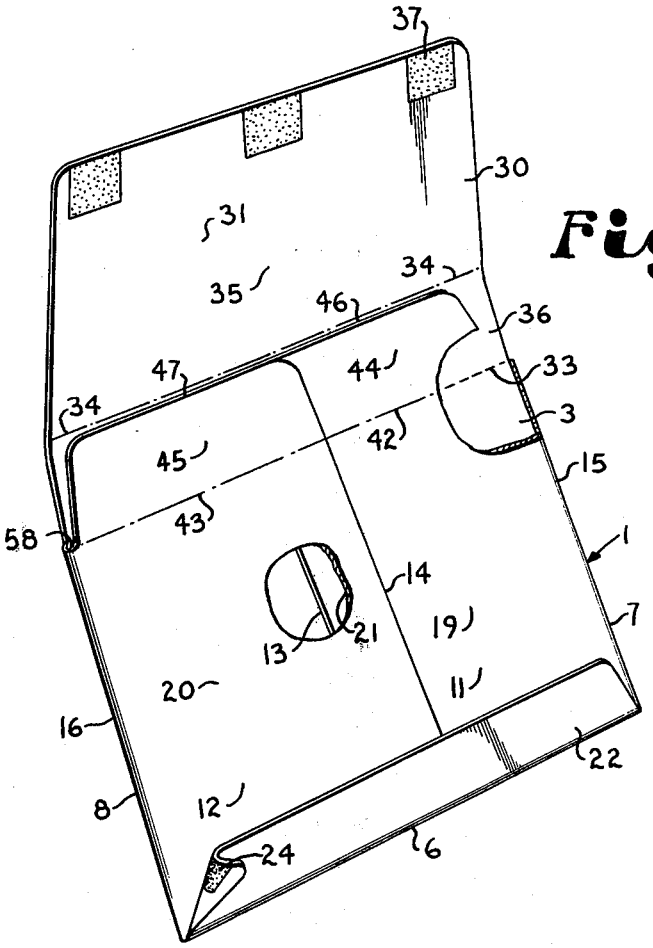
FIG. 1 is a perspective view of a two-way envelope embodying this invention with portions broken away to better illustrate the construction thereof.
Figure 2:
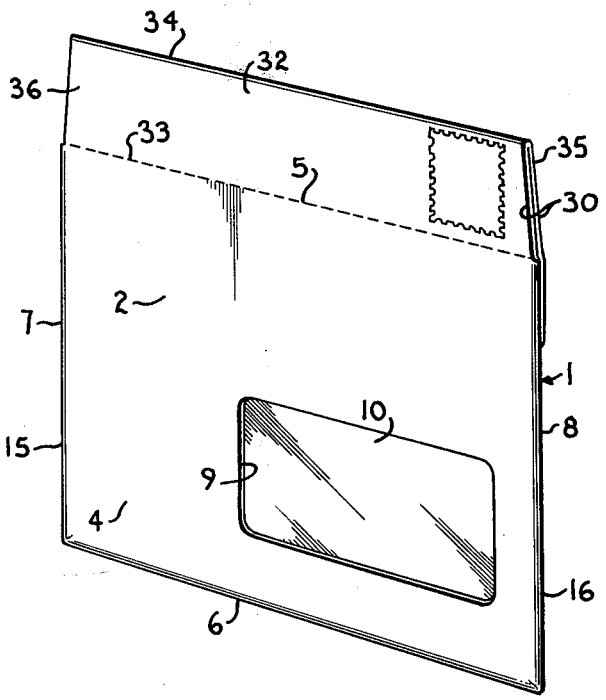
FIG. 2 is a perspective view of the envelope sealed for a first trip.

Referring to the drawings in more detail, the reference numeral 1 generally indicates a two-way, or return, envelope embodying this invention. The envelope 1 comprises a body panel 2 having an inner surface 3 and an outer surface 4. Upper and lower edges 5 and 6 and side edges 7 and 8 surround the body panel 2 and a window opening 9 extends therethrough. In this example, a transparent window patch 10 is adhesively connected to the body panel 2 on the inner surface 3 thereof so as to entirely cover the window opening 9.

A pair of opposed side flaps 11 and 12 exhibit outer edges 13 and 14, and are integrally connected to the body panel 2 by score or fold lines 15 and 16 extending along the body panel side edges 7 and 8. The side flaps 11 and 12 respectively have inner surfaces 17 and 18 and outer surfaces 19 and 20, the side flap 12 further displaying an adhesive area 21 extending along, and slightly spaced from, the outer edge 14 on the inner surface 18.

A bottom flap 22 is integrally connected to the body panel 2 and demarcated therefrom by a score or fold line 23 which extends along the body panel lower edge 6. An adhesive area 24 is located on the inner surface 25 of the bottom flap 22, preferably spaced below the score line 23 and slightly spaced upwardly from the lower edge of the bottom flap, as shown in FIG. 6.

A seal flap 30 has an inner surface 31, an outer surface 32 and is integrally connected to the body panel 2, demarcated therefrom by a tear line 33 extending along the body panel upper edge 5. In this example the tear line 33 is perforated for ease of tearing, however, a sharp fold line can also be used to weaken the connection and thereby control the separation upon tearing. A score line 34 extends along the seal flap 30 in a position parallel to and spaced upwardly from the body panel upper edge 5, FIG. 6. The seal flap 30 extends upwardly beyond the score line 34, forming an upper portion 35 thereabove, which, in this example, is substantially greater in vertical height than the lower portion 36 located between the score lines 34 and the tear line 33. Seal adhesive or gum 37, for example in the form of spaced spots, is located on the seal flap inner surface 31 adjacent the upper edge 38 of the upper portion 35.

Score or fold lines 42 and 43 extend along the respective side flaps 11 and 12 in locations preferably approximately colinear with, and continuations of, the body panel upper edge 5. The side flaps 11 and 12 respectively extend upwardly beyond the score or fold lines 42 and 43 forming upper side flap portions 44 and 45 which terminates in upper edges 46 and 47 positioned below but preferably approximately colinear with the seal flap score line 34, FIG. 6.

Figure 6:
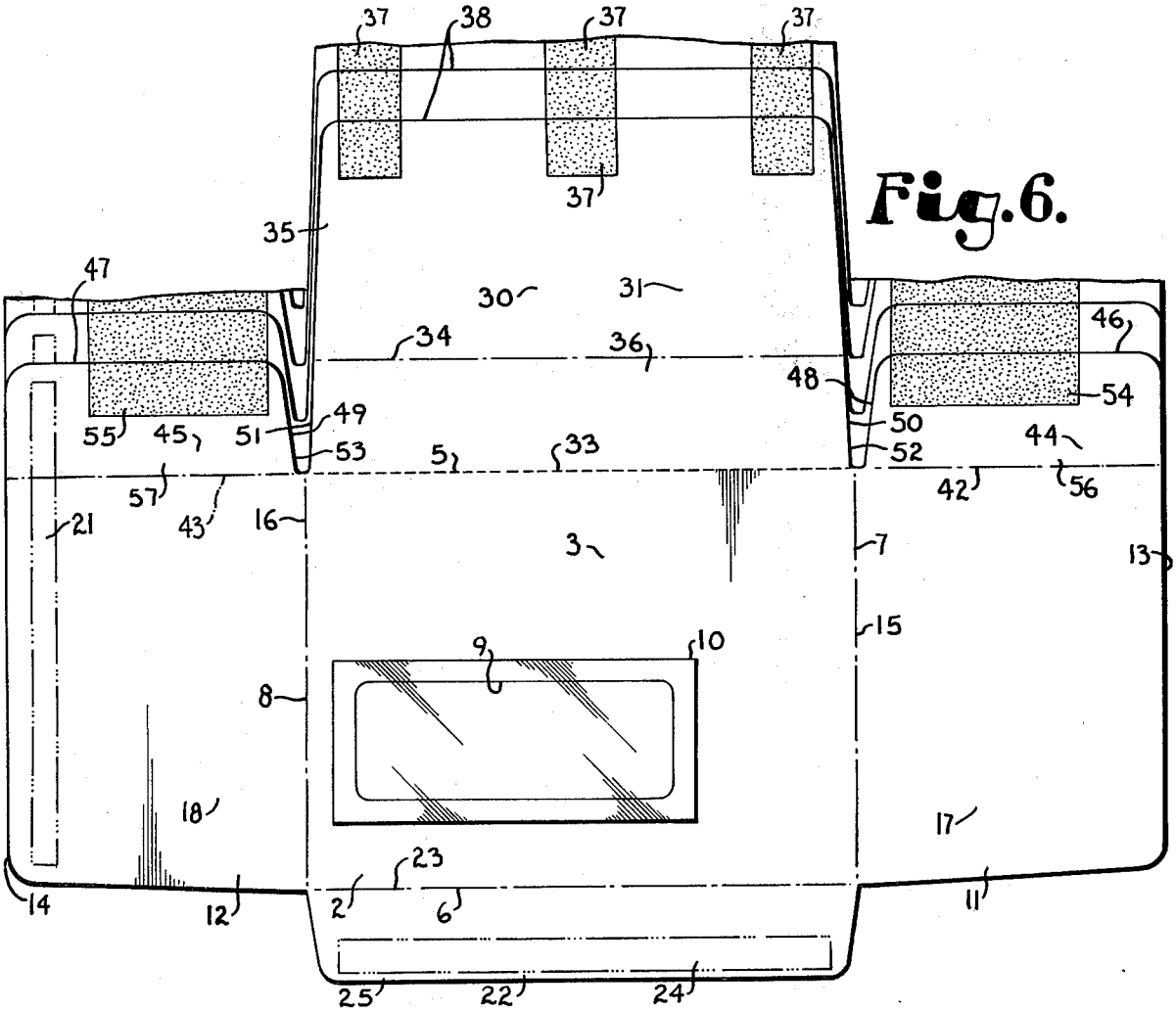
FIG. 6 is a plan view showing overlapping blanks somewhat as they would appear (except for phantom lines) just after adhesive application in the seal flap gumming station of a conventional automatic rotary envelope folding machine.

The side flap upper portions 44 and 45 respectively have an inner side edge 48 and 49 which, in the example of FIG. 6, is spaced from the respective side edges 50 and 51 of the seal flap 30 forming notch-like openings 52 and 53 therebetween extending downwardly to or slightly beyond the seal flap tear line 33. Seal gum or adhesive 54 and 55 is located on the inner surface 56 and 57 of the side flap upper portions 44 and 45 adjacent the upper edges 46 and 47.

In forming the envelope the side flaps 11 and 12 are folded inwardly along the body panel side edges 7 and 8, which correspond to the score lines 15 and 16, and over the body panel inner surface 3. The side flaps 11 and 12, due to their respective selected widths, partially overlap each other as best illustrated in FIG. 1, and are joined at the adhesive area 21, in the fashion of a so-called center seam envelope. The bottom flap 22 is folded along the body panel lower edge 6, corresponding to the score or fold line 23, and is joined to the side flap outer surfaces 19 and 20 along the bottom flap adhesive area 24.

The side flaps 11 and 12 and bottom flap 22, so folded and adhesively connected, form a pocket 58 which, prior to the first sealing of the envelope, may be opened by entry between the seal flap 30 and the side flap upper portions 44 and 45.

The seal gum or adhesive 37 which is applied to the seal flap 30 is preferably in the form of spaced spots, as shown, but, for example, may be of more continuous configuration and of the type which does not adhere strongly to a mating surface after sealing, so that the seal flap may be disconnected from the adhesively engaged surface without substantial damage.

Figure 3:
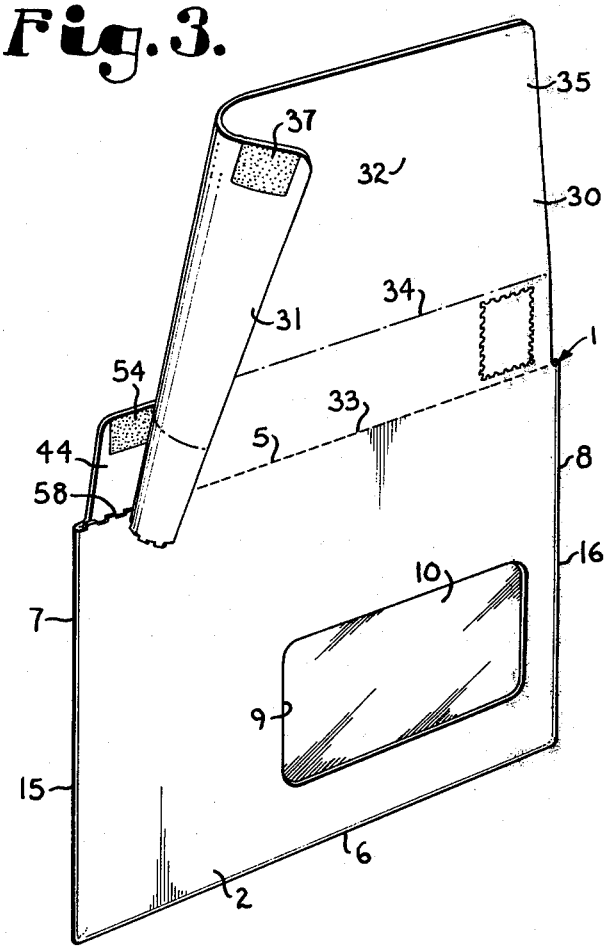
FIG. 3 is a perspective view of the envelope showing the seal flap opened upon first trip receipt and being removed from the body of the envelope in preparation for the second or return trip.

In utilizing the envelope construction as above described, after the desired insertion of materials (not shown) into the pocket 58, the seal flap 30 is folded along the fold line 34, over the side flap upper portions 44 and 45, and sealed against the outer surfaces 19 and 20 of the side flaps 11 and 12, to seal the pocket for a first trip. The recipient breaks the seal between the seal adhesive 37 and side flap outer surfaces 19 and 20 and thereby obtains access into the pocket 58 to remove the contents thereof. The materials to be returned may then be inserted into the pocket 58, with the proper address being displayed through the window opening 9, and the seal flap 30 removed from the body panel 2 by tearing along the tear line 33, FIG. 3. The removal of the seal flap 30 exposes the upper portions 44 and 45 of the side flaps 11 and 12, and particularly the seal adhesive 54 and 55 thereon, whereupon the upper portions 44 and 45 may be folded along the score lines 42 and 43 so that the seal adhesive 54 and 55 contacts the outer surface 4 of the body panel 2 for resealing the envelope, preparing same for a second, or return, trip.

Figure 7:
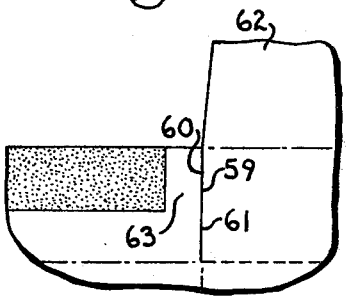
FIG. 7 is a fragmentary plan view showing a modified envelope construction wherein a slit is formed between the seal flap and the side flap upper portions.
Figure 4:
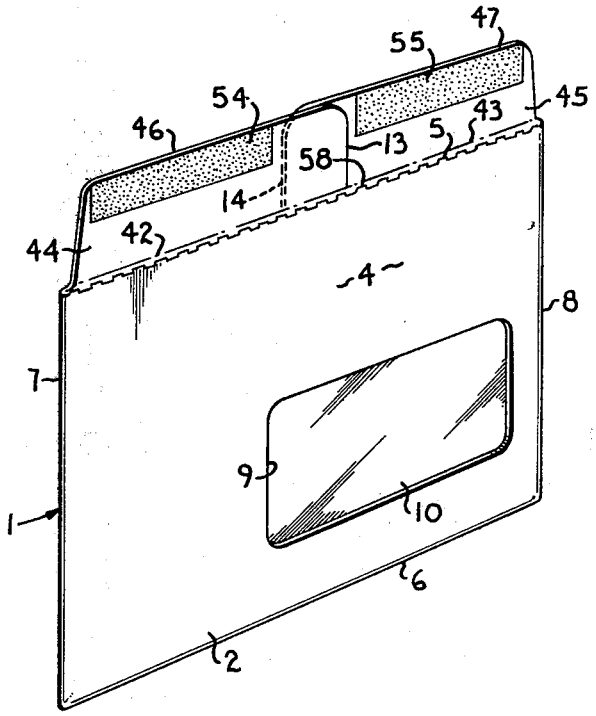
FIG. 4 is a perspective view of the envelope with the original seal flap entirely removed, illustrating the exposure of the second seal flap formed by upper portions of the side flaps.
Figure 5:
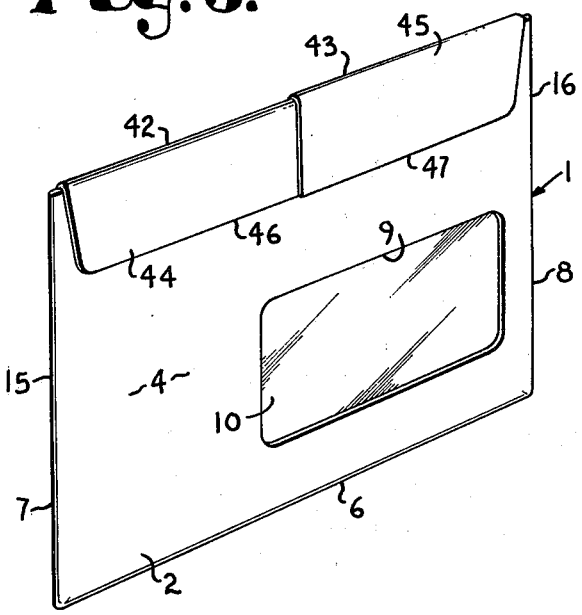
FIG. 5 is a perspective view of the envelope sealed with the second seal flap in preparation for the second trip.
Figure 8:
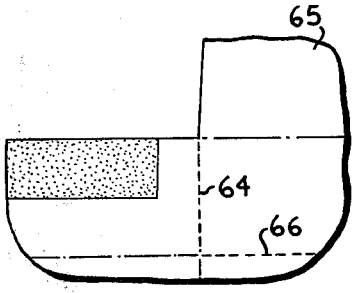
FIG. 8 is a plan view similar to FIG. 7 but showing a tear line between the seal flap and side flap upper portion.

Alternative embodiments of the envelope structure illustrated in FIGS. 7 and 8 are similar in construction to the envelope above described, except in FIG. 7 the notch-like openings 52 and 53 are not utilized but rather a slit 59 forms the side edges 60 and 61 respectively of the seal flap 62 and side flap upper portion 63. In FIG. 8 the slit is replaced by a tear line 64 which may be perforated and, in order to remove the seal flap 65 at the conclusion of the first trip, a tear is made through the tear lines 64 to the body panel upper edge tear line 66, which corresponds to the tear line 33 in the embodiment of FIG. 6.

The above described envelope constructions permit simple, direct and rapid manufacture with a minimum of operational steps, and on conventional rotary envelope folding machinery. While many of the prior art return envelopes require more complex and additional manufacturing steps over conventional one-way envelopes, the envelope constructions above described may be manufactured without such additional or more complex operations. One basis for this is the ability to apply the seal adhesive 37, 54 and 55 as a single operation and on the same surface of the envelope blank 70, FIG. 6. Thus, in the conventional seal flap gumming section of a rotary envelope folding machine (not shown) multiple blanks 70 are positioned in a close-step of staggered formation, and are maintained in this formation while seal gum or adhesive may be continuously applied, for example, by a conventional application roller (not shown) which is suitably notched so as to apply the gum simultaneously along the several strips forming the locations of the seal adhesive applications; that is, seal gum 37, 54 and 55. After drying of the seal gum in the conventional manner (for example, see U.S. Pat. No. 3,382,778), the application of adhesive area 21 and folding of the side flaps 11 and 12 over the body panel 2 causes the side flap gum 54 and 55 to face and remain in a direction opposite to the seal flap adhesive 37. Such folding and connection of the side flaps together, with additional conventional steps utilized to produce common one-way envelopes, such as the application of adhesive to the area 24 and folding of the bottom flap, then produces the desired construction.

It is to be understood that while certain forms of this invention have been illustrated and described it is not to be limited thereto except in so far as such limitations are included in the following claims.

What I claim and desire to secure by Letters Patent is:

1. A two-way envelope comprising:

(a) a body panel having an inner and an outer surface, upper and lower edges and side edges, (b) a pair of opposed side flaps having outer edges and being integrally connected to said body panel and demarcated from said body panel side edges, said side flaps having an inner and an outer surface, (c) a bottom flap integrally connected to said body panel and demarcated therefrom by a fold line along said body panel lower edge, (d) a seal flap having an inner surface and an outer surface, said seal flap being integrally connected to said body panel and demarcated therefrom by a tear line along said body panel upper edge, a fold line extending along said seal flap which is spaced upwardly from said body panel upper edge, said seal flap extending upwardly beyond said seal flap fold line forming an upper portion thereabove, seal adhesive on said seal flap inner surface upper portion, (e) a fold line extending along said respective side flaps and approximately colinear with said body panel upper edge, said side flaps each having an upper portion extending upwardly beyond said side flap fold lines and terminating in an upper edge below said seal flap fold line, (f) said side flap upper portions having an inner side edge and seal adhesive on said side flap inner surfaces, (g) said side flaps being folded along said body panel side edges over said body panel inner surface, said side flaps partially overlapping each other and being adhesively joined, said bottom flap being folded along said body panel lower edge and joined to at least one of said side flaps, said side flaps and bottom flap and body panel forming a pocket open between said seal flap and said side flap upper portions, (h) said seal flap being folded along said seal flap fold line over said side flap upper portions to seal said pocket for a first trip, said seal flap being disconnected from said body panel along said seal flap tear line and said side flap upper portions being folded along said side flap fold lines to seal said pocket for a second trip.

2. The envelope as set forth in claim 1 including:

(a) a window opening through said body panel.

3. The envelope as set forth in claim 1 wherein:

(a) a notch is formed between said respective side flap upper portions and said seal flap.

4. The envelope as set forth in claim 1 wherein:

(a) a slit is formed between said respective side flap upper portions and said seal flap.

5. The envelope as set forth in claim 1 wherein:

(a) a tear line is formed between said respective side flap upper portions and said seal flap.

6. The envelope as set forth in claim 1 wherein:

(a) said seal flap score line is substantially parallel to said body panel upper edge.

7. In a two-way envelope having a body panel, a pair of opposed side flaps connected to said body panel, and a seal flap connected to said body panel and demarcated therefrom by a tear line;

(a) a fold line extending along said seal flap which is spaced upwardly from said tear line, said seal flap extending upwardly beyond said seal flap fold line forming an upper portion thereabove with seal adhesive thereon, (b) a fold line extending along said respective side flaps and approximately parallel to said tear line, said side flaps each having an upper portion extending upwardly beyond said side flap fold lines, and (c) seal adhesive on said side flap upper portions, and facing in a direction opposite from said seal flap adhesive when said side flaps are folded over said body panel.

* * * * *